US006445898B2

(12) United States Patent
Chang et al.

(10) Patent No.: US 6,445,898 B2
(45) Date of Patent: Sep. 3, 2002

(54) CLEANING STRUCTURE FOR A DEVELOPING UNIT OF LIQUID ELECTROPHOTOGRAPHIC PRINTER

(75) Inventors: Kee-son Chang, Suwon; Yong-kook Kim; Seung-young Byun, both of Seongnam; Jae-young Jang, Suwon; Ji-won Seo, Kunpo, all of (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 09/725,886

(22) Filed: Nov. 30, 2000

(30) Foreign Application Priority Data

Apr. 26, 2000 (KR) ..... 00-22160

(51) Int. Cl.[7] ..... G03G 15/10
(52) U.S. Cl. ..... 399/249
(58) Field of Search ..... 399/249, 348

(56) References Cited

U.S. PATENT DOCUMENTS 6,085,054 A * 7/2000 Kusayanagi ..... 399/249
6,317,578 B1 * 11/2001 Kusayanagi ..... 399/249 X

FOREIGN PATENT DOCUMENTS

| | | |
|---|---|---|
| JP | 55-137554 A | 10/1980 |
| JP | 6-214466 A | 8/1994 |
| JP | 8-123207 A | 5/1996 |
| JP | 11-231746 A | 8/1999 |
| JP | 11-282257 A | 10/1999 |
| JP | 2001-117372 A | 4/2001 |

* cited by examiner

*Primary Examiner*—William J. Royer
(74) *Attorney, Agent, or Firm*—Sughrue Mion, PLLC

(57) ABSTRACT

A developing unit of a liquid electrophotographic printer includes a developing roller, for forming a development gap with a photoreceptor web where developer is filled and developing an electrostatic latent image formed on the photoreceptor web, a squeegee roller installed at the rear end of the developing roller for closely pressing the photoreceptor web to squeegee surplus developer, and a cleaning mechanism for removing toner particles of the developer adhering to a surface of the squeegee roller using an electrical force. Since the toner particles adhering to the squeegee roller are removed, contamination of a developed image is prevented and a clean image can be printed.

17 Claims, 5 Drawing Sheets

CLEANING STRUCTURE FOR A DEVELOPING UNIT OF LIQUID ELECTROPHOTOGRAPHIC PRINTER

BACKGROUND OF THE INVENTION

1. Field of the Invention

The present invention relates to a developing unit of a liquid electrophotographic printer, and more particularly, to a developing unit of a liquid electrophotographic printer having an improved structure for cleaning the surface of a squeegee roller.

2. Description of the Related Art

A typical liquid electrophotographic printer such as a color laser printer includes a developing unit 10 for developing an electrostatic latent image formed on a photoreceptor web 1 by means of light scanning by a laser scanner to form an image of a predetermined color, as shown in FIG. 1. The developing unit 10 includes a developing roller 11 for developing the electrostatic latent image by forming a development gap G with the photoreceptor web 1 which is about 150 $\mu$m and filled with developer, a squeegee roller 12 installed at the rear end of the developing roller 11 for pressing the photoreceptor web 1 to squeegee surplus developer after development, and a manifold 15 installed to enclose part of the outer circumferential surface of the developing roller 11 for guiding flow of the developer so that the developer pumped from a developing tank 20 is continuously provided to the development gap G. Reference numeral 13 denotes a brush roller for brushing the developer flowing down along the outer circumferential surface of the developing roller 11 to prevent it from entering the development gap G again. Reference numeral 16 denotes a blade installed to contact the developing roller 11 to perform the same function. Reference numeral 14 denotes a blade for squeegee roller 12. The squeegee roller blade 14 is off the squeegee roller 12 during development but contacts the squeegee roller 12 during a drip-line removing mode after the development is completed. A drip-line removing mode is a mode in which the squeegee roller 12 is rotated in a direction opposite to the direction in which the photoreceptor web 1 circulates so as to remove the developer adhering to the photoreceptor web 1 between the squeegee roller 12 and the developing roller 11. Reference numerals 11*a* and 12*a* denote a development backup roller and a squeegee backup roller, respectively.

When development is carried out in the above structure, a voltage of about +600 V is applied to the photoreceptor web 1. The voltage in an area of the photoreceptor web 1 where the electrostatic latent image is formed by light scanning of the laser scanner 30 drops to about +100 V. A voltage of about +400 V is applied to the developing roller 11. Since toner particles distributed in solvent of developer are charged positively, the toner particles in the developer which is provided to the development gap G adhere to the electrostatic latent image having a relatively low voltage. That is, the electrostatic latent image is developed. The surplus developer is removed by the squeegee roller 12.

When the development is repeated, toner particles of the developer adhere to the squeegee roller 12. The squeegee roller 12 squeegees surplus developer and concurrently presses the developed image to make it filmy. Here, some toner particles on the developed image adhere to the squeegee roller 12. The toner particles adhering to the squeegee roller 12 are transferred to the next image, such that the subsequent images may be continuously contaminated. In particular, in the case of a color laser printer for developing and printing a color image, since four colors are developed by four developing units in order to make a color image, if toner particles adhering to the squeegee roller 12 are mixed, an image of a desired color cannot be realized. For example, when four developing units are arranged to develop four colors, that is, yellow, cyan, magenta and black, it is assumed that the toner image developed by the first yellow developing unit passes a squeegee roller of the second cyan developing unit. Here, the toner particles of a cyan color developed on the photoreceptor web 1 are pressed to adhere to the squeegee roller of the cyan developing unit, that is, a reverse transfer occurs. The cyan toner particles adhere to the subsequent image passing the yellow developing unit so that the image is contaminated. Such a phenomenon is repeatedly generated on the surface of an image of the photoreceptor web 1 corresponding to the circumference of the squeegee roller, which is referred to as a squeegee offset phenomenon.

The proceeding status of the squeegee offset phenomenon is shown in FIGS. 2 through 4. That is, as shown in FIG. 2, when toner images C and Y developed by a cyan developing unit and a precedent yellow developing unit pass the squeegee roller 12 of the, cyan developing unit, the cyan image C is pressed first by the squeegee roller 12, as shown in FIG. 3. Here, some toner C' of the image is reverse transferred to the squeegee roller 12 and adheres to the subsequent yellow image Y, as shown in FIG. 4. Such a phenomenon becomes serious in the subsequent image among the four developing units since the squeegee offset phenomena at the precedent units are overlapped continuously. Thus, the above phenomenon is a hindrance to a high quality image and further causes contamination of developer in the subsequent developing unit.

To overcome the above problem, a means for cleaning the surface of the squeegee roller 12 with only a mechanical force utilizing a frictional contact has been suggested. However, the load to the rotating squeegee roller greatly increases. Since the squeegee roller 12 is driven by a driving force of the photoreceptor web 1, if the squeegee roller 12 is not properly rotated, an image is deteriorated. Also, when the squeegee roller 12 is formed of a material having a low surface energy, that is, a low frictional force, slippage is generated between the squeegee roller 12 and the photoreceptor web 1 so that an image is deteriorated.

Therefore, a plan is needed to effectively handle toner particles which are reversely transferred to the surface of the squeegee roller 12.

SUMMARY OF THE INVENTION

To solve the above problems, it is an objective of the present invention to provide a developing unit of a liquid electrophotographic printer which is improved to effectively remove toner particles of developer adhering to the surface of the squeegee roller.

Accordingly, to achieve the above objective, there is provided a developing unit of a liquid electrophotographic printer which comprises a developing roller for forming a development gap with a photoreceptor web where developer is filled and developing an electrostatic latent image formed on the photoreceptor web, a squeegee roller installed at the rear end of the developing roller for closely pressing the photoreceptor web to squeegee surplus developer, and a cleaning mechanism for removing toner particles of the developer adhering to a surface of the squeegee roller using an electrical force.

It is preferred in the present invention that the cleaning mechanism comprises a cleaning roller installed to maintain a predetermined gap with the squeegee roller, a first voltage applying portion for applying a voltage to the squeegee roller; and a second voltage applying portion for applying a voltage lower than that of the squeegee roller to the cleaning roller, wherein the toner particles adhering to the squeegee roller move to the cleaning roller via a developer film formed at the gap due to a difference in voltage.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
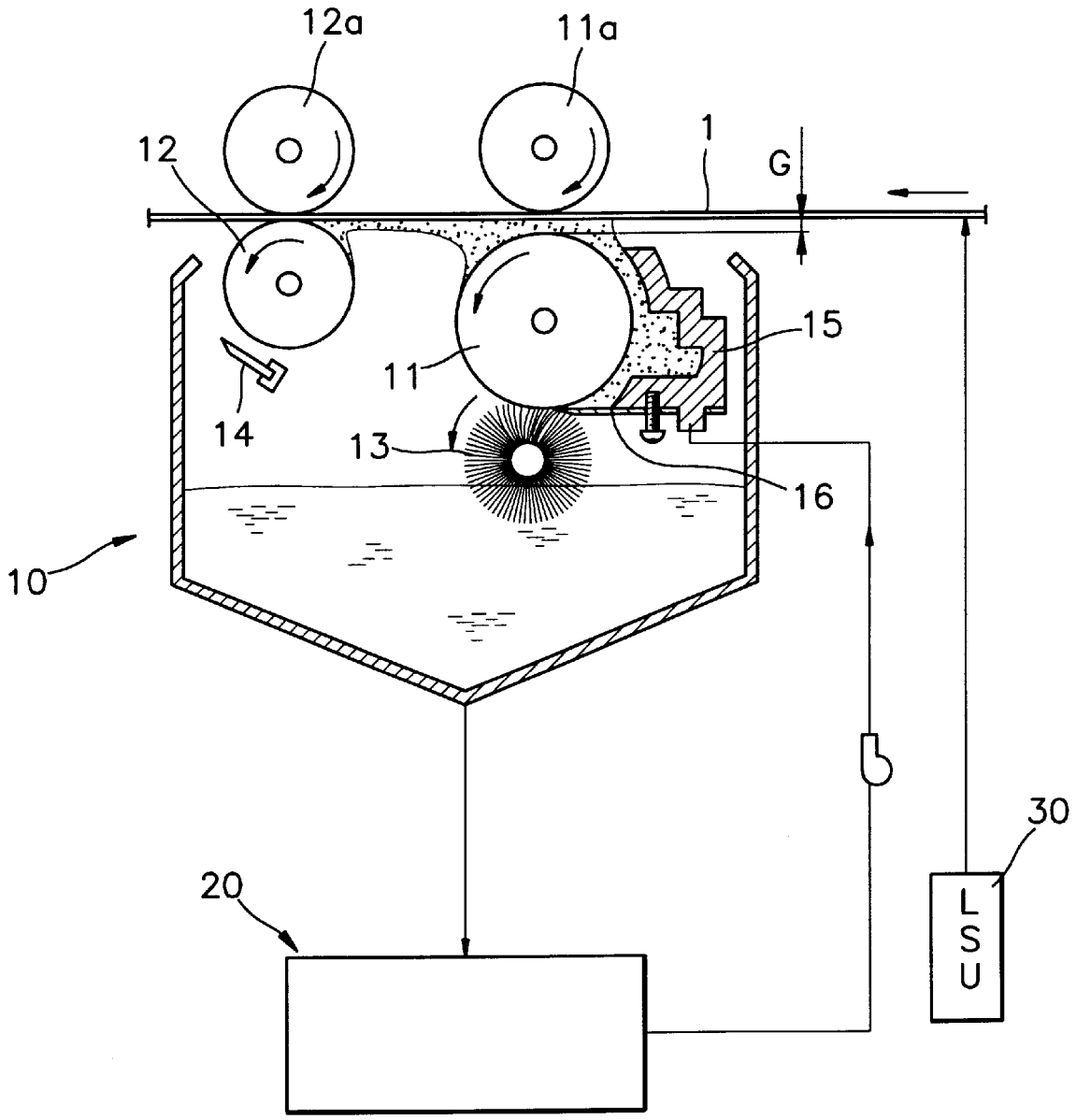
FIG. 1 (PRIOR ART)
FIG. 1 is a view showing the conventional developing unit.
Figure 2:
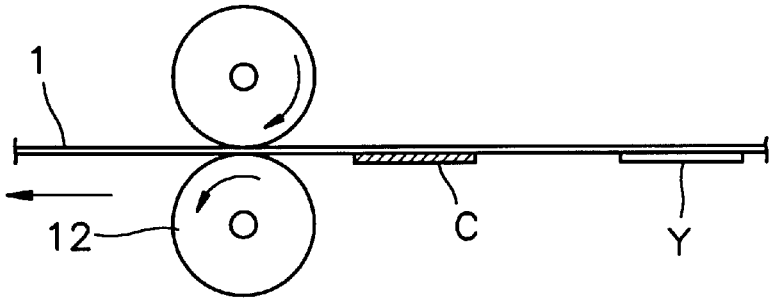
FIG.2 (PRIOR ART)
FIGS. 2 through 4 are views for explaining a squeegee offset phenomenon.
Figure 3:
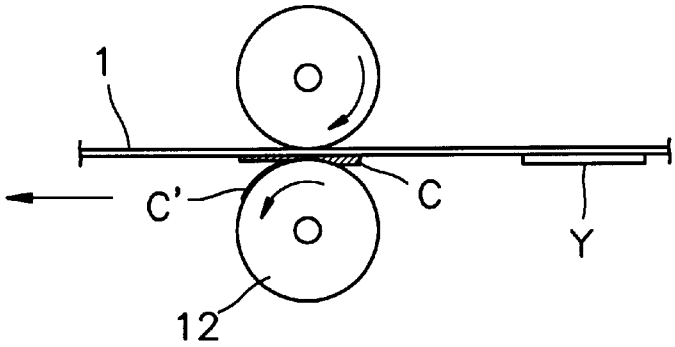
FIG.3 (PRIOR ART)
Figure 4:
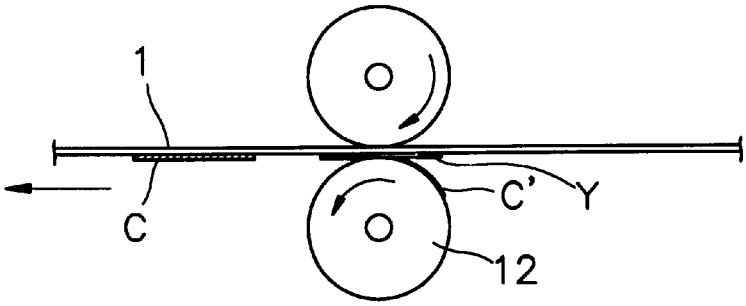
FIG.4 (PRIOR ART)
Figure 5:
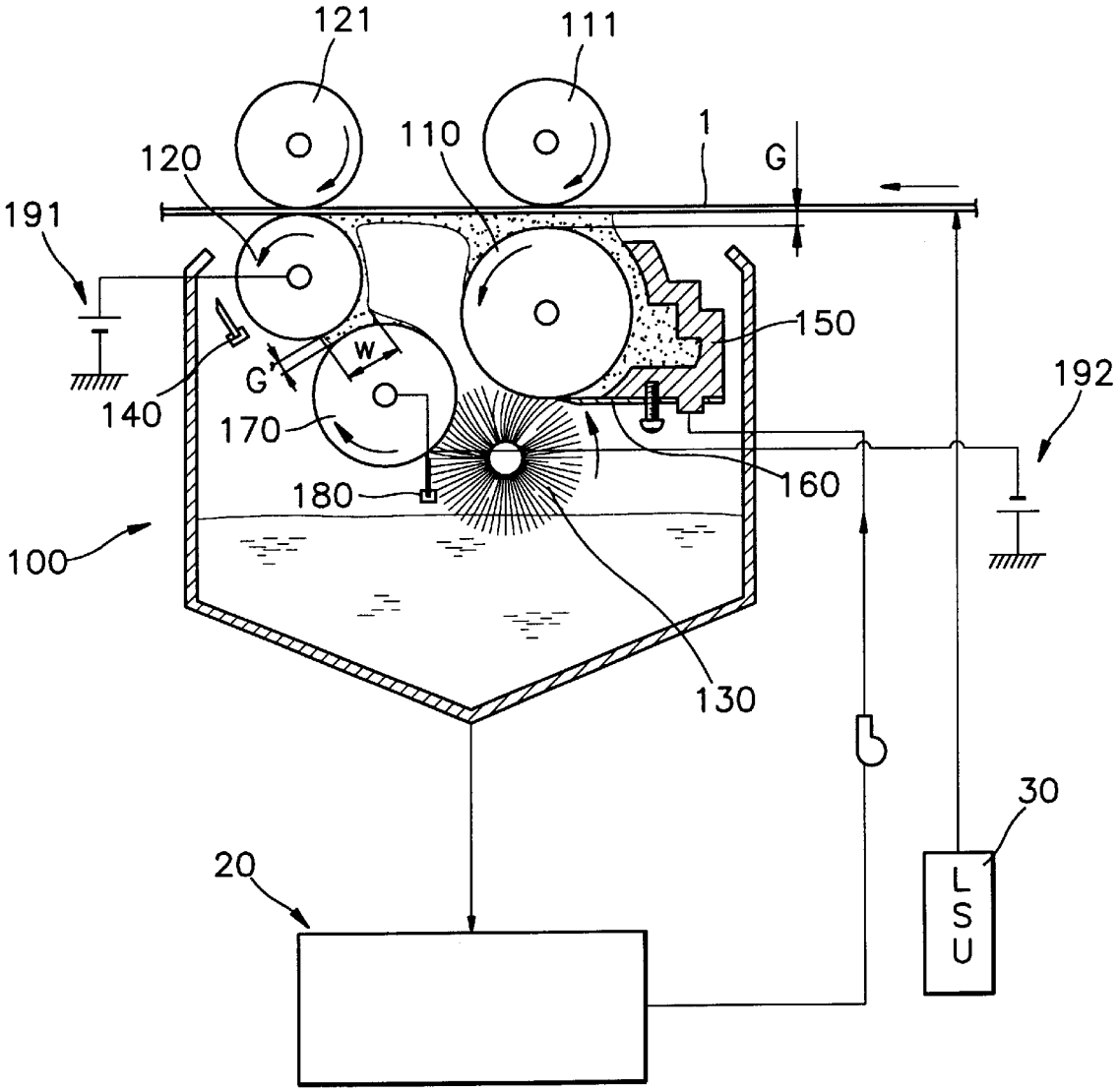
FIG. 5 is a view showing a developing unit according to a preferred embodiment of the present invention.

Referring to FIG. 5, a developing unit 100 includes a developing roller 110 for developing an electrostatic latent image formed on the photoreceptor web 1, and a squeegee roller 120 for squeegeeing surplus developer from a developed image. A voltage of about +600 V is applied to the photoreceptor web 1 while a voltage of a portion thereof where the electrostatic latent image is formed by light scanning by the laser scanner 30 drops to about +100 V. A voltage of+400 V is applied to the developing roller 110 and charged toner particles in the development gap G adhere to the electrostatic latent image due to the difference in voltage so that the electrostatic latent image is developed. The squeegee roller 120 presses the photoreceptor web 1 at the rear end of the developing roller 110 to squeegee the surplus developer. Reference numerals 111 and 121 denote a development backup roller and a squeegee backup roller, respectively.

It is a characteristic feature of the present invention to include a cleaning mechanism which removes toner particles by cleaning the surface of the squeegee roller 120 by using an electrical force. For this purpose, the squeegee roller 120 is preferably formed by polyurethane rubber of which a surface portion has a Shore rigidity of 50–60 and electrical resistivity of $10^6$–$10^8$ Ωcm. Accordingly, the squeegee roller 120 can elastically press the photoreceptor web 1 against the squeegee backup roller 121 due to the elasticity of rubber. Also, since the above polyurethane rubber is conductive, when a voltage is applied, current can flow. The reason for applying a voltage is to remove toner by an electrical force as above. A detailed mechanism will be described later. The cleaning mechanism includes a cleaning roller 170 installed such that it can maintain a gap G' of about 150 μm with the squeegee roller 120, a first voltage applying portion 191 for applying a voltage to the squeegee roller 120, and a second voltage applying portion 192 for applying a voltage to the cleaning roller 170. The first voltage applying portion 191 applies a voltage of +400 through +450 V to the squeegee roller 120 and the second voltage applying portion 192 applies −1 kV through −1.5 kV to the cleaning roller 170 which is a voltage lower than that of the squeegee roller 120. That is, a voltage difference is generated to form an electrical force toward the cleaning roller 170 from the squeegee roller 120.

Here, since a reverse transfer toward the photoreceptor web 1 does not occur when the squeegee roller 120 forms a voltage lower than the photoreceptor web 1 which is charged to +600 V, a voltage of +400 through +450 V which is similar to that of the developing roller 110 is applied to the squeegee roller 120. A voltage difference, ΔV, between the squeegee roller 120 and the cleaning roller 170 for effective cleaning can be calculated from an equation that $\Delta V=(d^2 \times Vp)/(\mu \times w)$. Here, d is 150 m, which is the width of the gap G' between the squeegee roller 120 and the cleaning roller 170; Vp is 81.3 mm/sec, which is the circulating speed of the photoreceptor web 1 during development; μis $4 \times 10^{-4}$ $mm^2$/Vsec, which is the mobility of the toner particles of developer; and w is 5 mm, which is the width W of the developer film formed on the gap G'.

The equation is obtained from the following processes. The voltage E of the cleaning roller 170 can be represented by $(\Delta V/d)(1+Rs/Rn)$. Here, Rs is a resistance of the squeegee roller 120 and Rn is a resistance of the developer film. However, since Rs/Rn is a very tiny value, it can be represented that E ΔV/d. To achieve effective cleaning, it is preferable that the time when toner particles move toward the cleaning roller 170 through the developer film is shorter than a process time, that is, the time when the width W of the developer film rotates as the photoreceptor web 1 circulates and the squeegee roller 120 is driven. This can be expressed as $d/V<w/Vp$. V is a movement speed of the particles which can be replaced by μE. To summarize the above, $E \approx \Delta V/d > d \times Vp/\mu \times w$. Consequently, the equation that $\Delta V=(d^2 \times Vp)/(\mu \times w)$ is obtained.

When the above values are replaced in the equation, ΔV is produced to be about 1.5 kV. Thus, since +400 through 450 V is applied to the squeegee roller 120, effective cleaning is achieved by applying a voltage of −1 kV through −1.5 kV to the cleaning roller 170 to maintain a voltage difference of 1.5 kV. At least 1 kV of the voltage difference should be maintained to properly perform cleaning.

By this voltage difference, an electrical force to transfer positively charged particles to the cleaning roller 170 from the squeegee roller 120 is formed in the development gap G'. Since each toner particle of the developer is charged to be positive, if the particles adhere to the surface of the squeegee roller 120, the particles move toward the cleaning roller 170 due to the electrical force. The toner particles returned to the cleaning roller 170 are removed by a brush roller 130 and a blade 180 brushing the surface of the cleaning roller 170. Here, the brush roller 130 is arranged to clean not only the cleaning roller 170 but also the developing roller 110. The cleaning roller 170 is maintained to be a predetermined distance away from the developing roller 110 so that no sparks are generated due to a voltage applied to both the rollers. Reference numeral 140 denotes a blade closely contacting the squeegee roller 120 when a drip-line is removed, and reference numeral 160 denotes a blade installed to contact the developing roller 110.

In the above structure, when a development process begins, developer is provided from the developer tank 20 to the development gap G via a manifold 150. The electrostatic latent image formed on the photoreceptor web 1 passes through the development gap G and is developed into an image of a predetermined color by the charged toner particles. The surplus developer not contributing to the development is removed by the squeegee roller 120. The toner particles adhering to the surface of the squeegee roller 120 are moved to the cleaning roller 170 through the development film formed on the gap G' due to the voltage difference between the squeegee roller 120 and the cleaning roller 170. Then, the toner particles moved to the cleaning roller 170 are removed from the surface thereof by the brush roller 130 and the blade 180. Thus, if the toner particles adhere to the squeegee roller 120, they are immediately moved to the cleaning roller 170 and removed therefrom so that the image developed on the photoreceptor web 1 is not contaminated.

Figure 6:
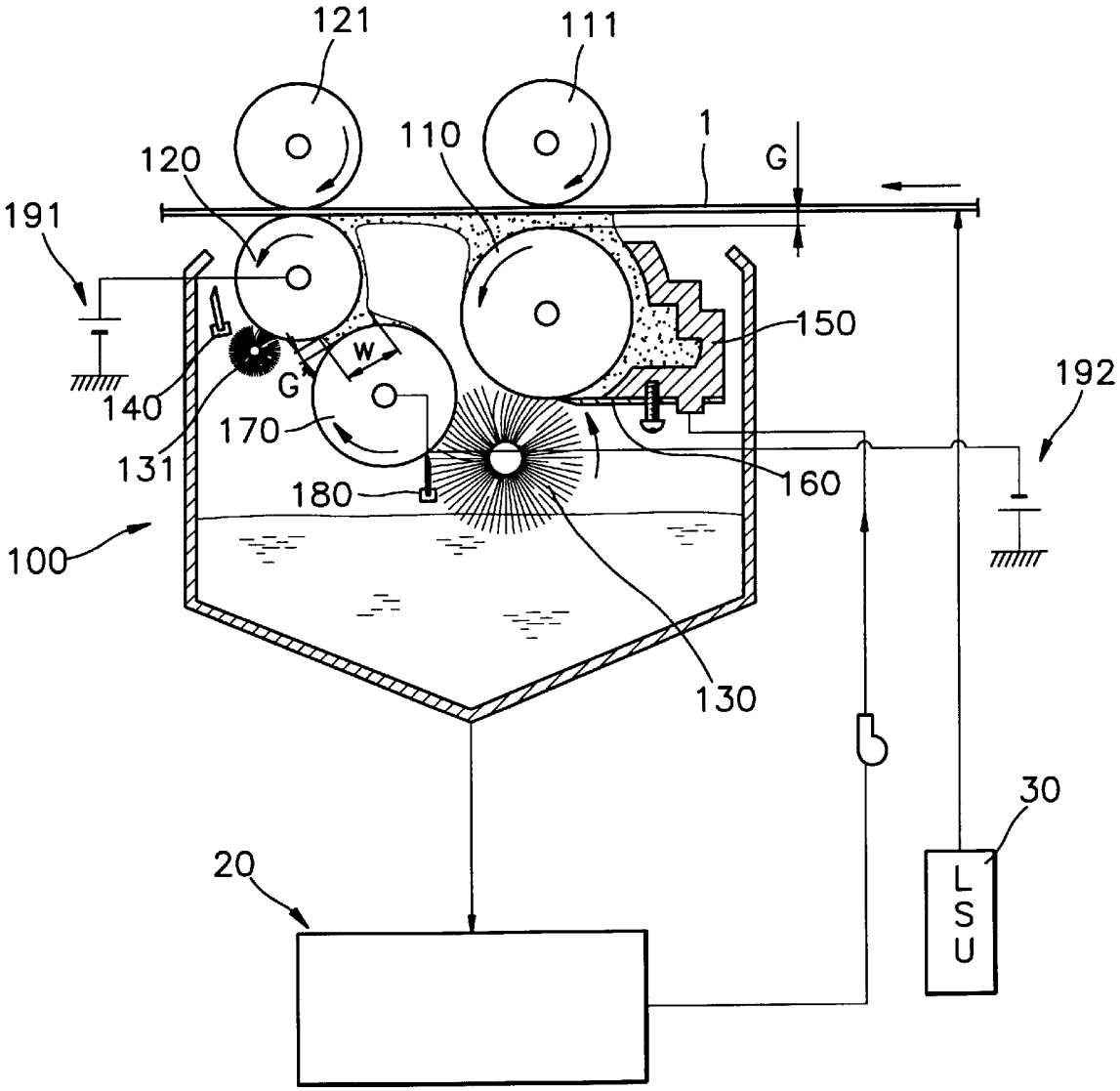
FIG. 6 is a view showing a developing unit according to another preferred embodiment of the present invention.

FIG. 6 shows a developing unit of a liquid electrophotographic printer according to another preferred embodiment of the present invention. The structure of the present embodiment is almost the same as that of the previous embodiment, but distinguished in that a brush roller 131 for the squeegee roller 120 is further installed. That is, in the present embodiment, to remove the toner particles adhering to the squeegee roller 120, a mechanical force by the brush roller 131 is added in addition to the electrical force in the previous embodiment. Thus, the toner particles adhering to the squeegee roller 120 are primarily removed by the mechanical force of the brush roller 131. Here, the toner particles are provided with mobility. Then, the toner particles are removed by the electrical force formed by the first and second voltage applying portions 191 and 192, assuring that the toner particles on the surface of the squeegee roller 120 are removed. The other structure and operational principle are the same as those of the previous embodiment.

Figure 7:
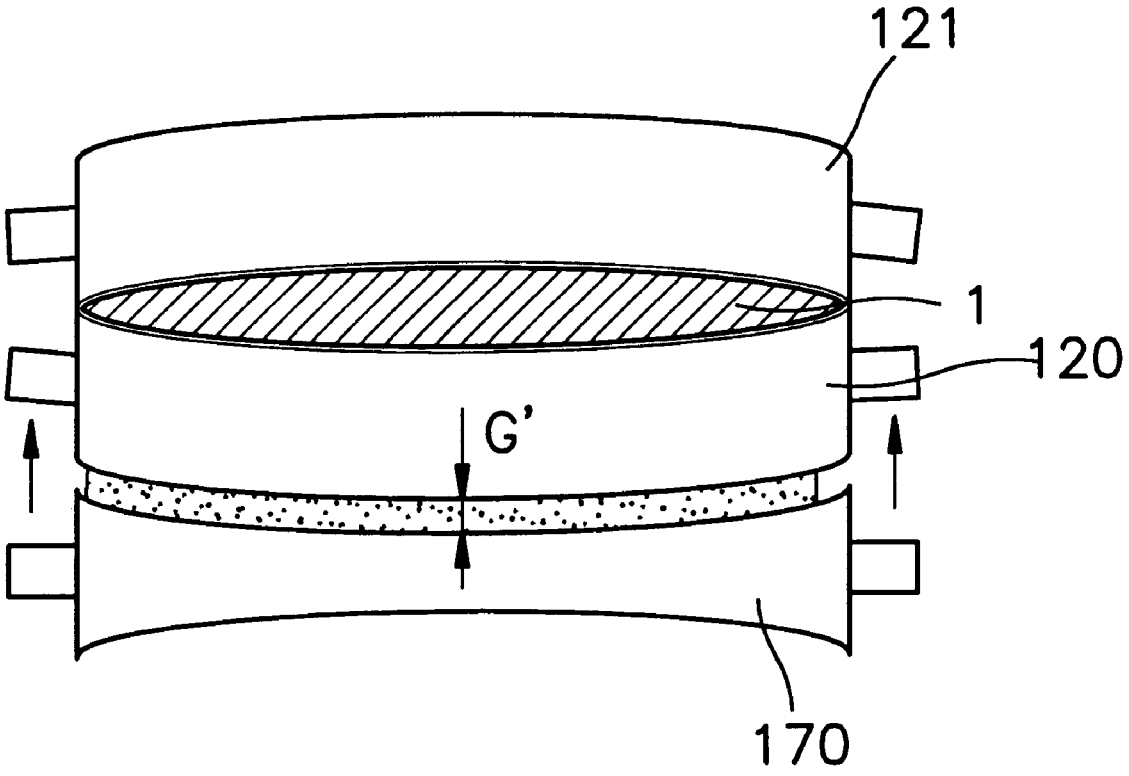
FIG. 7 is a view showing a negative crown shape of a cleaning roller adopted in the present invention.

The shape of the cleaning roller 170 is preferably formed to be a negative crown, as shown in FIG. 7. This is because, when the squeegee roller 120 closely presses the photoreceptor web 1 against the squeegee backup roller 121, a phenomenon that the roller is bent occurs, as shown in FIG. 7. If the phenomenon occurs, either end portion of the gap between the squeegee roller 120 and the cleaning roller 170 is widened so that a degree of cleaning differs at the middle portion and both end portions. Thus, by forming the cleaning roller 170 to be a negative crown, the gap difference between the middle portion and both end portions due to the bent squeegee roller 120 is compensated for so that relatively uniform cleaning is performed.

Therefore, a phenomenon of the toner particles adhering to the squeegee roller 120 and contaminating the subsequent image is prevented by the above cleaning mechanism.

As described above, in the developing unit of a liquid electrophotographic printer, since the toner particles adhering to the squeegee roller are removed, contamination of a developed image is prevented and a clean image can be printed.

It is contemplated that numerous modifications may be made to the developing unit of the present invention without departing from the spirit and scope of the invention as defined in the following claims.

What is claimed is:

1. A developing unit of a liquid electrophotographic printer, comprising:

a developing roller which forms a development gap with a photoreceptor web where developer is filled and develops an electrostatic latent image formed on the photoreceptor web;

a squeegee roller installed at the rear end of the developing roller and which closely presses the photoreceptor web to squeegee surplus developer; and a cleaning mechanism which removes toner particles of the developer adhering to a surface of the squeegee roller using an electrical force, wherein the cleaning mechanism comprises a cleaning roller installed to maintain a predetermined gap with the squeegee roller.

2. The developing unit as claimed in claim 1, further comprising:

a first voltage applying portion which applies a voltage to the squeegee roller; and a second voltage applying portion which applies a voltage to the cleaning roller lower than that of the squeegee roller, wherein the toner particles adhering to the squeegee roller move to the cleaning roller via a developer film formed at the predetermined gap due to a difference in voltage.

3. The developing unit as claimed in claim 1, wherein a voltage difference between the squeegee roller and the cleaning roller is 1 kV or more.

4. The developing unit as claimed in claim 1, wherein the cleaning mechanism further comprises a blade, installed to rotate while one end thereof contacts the surface of the cleaning roller, said blade removing the toner particles adhering to a surface of the cleaning roller according to rotation of the cleaning roller.

5. The developing unit as claimed in claim 1, wherein the cleaning mechanism further comprises a brush roller, installed to rotate in contact with the surface of the squeegee roller, and which removes the toner particles adhering to the surface of the squeegee roller.

6. The developing unit as claimed in claim 1, wherein the cleaning mechanism further comprises a brush roller, installed to rotate in contact with a surface of the cleaning roller, and which removes the toner particles adhering to the surface of the cleaning roller.

7. The developing unit as claimed in claim 6, wherein the brush roller is arranged to rotate in contact with the developing roller so that the brush roller also cleans the developing roller.

8. The developing unit as claimed in claim 1, wherein the cleaning roller has a negative crown shape.

9. A developing unit of a liquid electrophotographic printer, comprising:

a developing roller which forms a development gap with a photoreceptor web where developer is filled and develops an electrostatic latent image formed on the photoreceptor web;

a squeegee roller installed at the rear end of the developing roller and which closely presses the photoreceptor web to squeegee surplus developer; and a cleaning mechanism which removes toner particles of the developer adhering to a surface of the squeegee roller using an electrical force, wherein the cleaning mechanism comprises:

a cleaning roller installed to maintain a predetermined gap with the squeegee roller;

a first voltage applying portion which applies a voltage to the squeegee roller; and a second voltage applying portion which applies a voltage to the cleaning roller lower than that of the squeegee roller, wherein the toner particles adhering to the squeegee roller move to the cleaning roller via a developer film formed at the predetermined gap due to a difference in voltage.

10. The developing unit as claimed in claims 9, wherein the cleaning mechanism further comprises a blade, installed to rotate while one end thereof contacts the surface of the cleaning roller, said blade removing the toner particles adhering to a surface of the cleaning roller according to rotation of the cleaning roller.

11. The developing unit as claimed in claim 9, wherein the cleaning mechanism further comprises a brush roller, installed to rotate in contact with the surface of the squeegee roller, and which removes the toner particles adhering to the surface of the squeegee roller.

12. The developing unit as claimed in claim 9, wherein the cleaning mechanism further comprises a brush roller, installed to rotate in contact with a surface of the cleaning roller, and which removes the toner particles adhering to the surface of the cleaning roller.

13. The developing unit as claimed in claim 11, wherein the brush roller is arranged to rotate in contact with the developing roller so that the brush roller also cleans the developing roller.

14. The developing unit as claimed in claim 9, wherein a voltage difference between the squeegee roller and the cleaning roller is 1 kV or more.

15. The developing unit as claimed in claim 9, wherein the cleaning roller has a negative crown shape.

16. A developing unit of a liquid electrophotographic printer, comprising:

a developing roller which forms a development gap with a photoreceptor web where developer is filled and develops an electrostatic latent image formed on the photoreceptor web;

a squeegee roller installed at the rear end of the developing roller and which closely presses the photoreceptor web to squeegee surplus developer; and a cleaning mechanism comprising a cleaning roller, wherein said cleaning mechanism removes toner particles of the developer adhering to a surface of the squeegee roller using an electrical force, wherein a voltage difference between the squeegee roller and the cleaning roller is 1 kV or more.

17. A developing unit of a liquid electrophotographic printer, comprising:

a developing roller which forms a development gap with a photoreceptor web where developer is filled and develops an electrostatic latent image formed on the photoreceptor web;

a squeegee roller installed at the rear end of the developing roller and which closely presses the photoreceptor web to squeegee surplus developer; and a cleaning mechanism comprising a cleaning roller, wherein said cleaning mechanism removes toner particles of the developer adhering to a surface of the squeegee roller using an electrical force, wherein the cleaning roller has a negative crown shape.

* * * * *